United States Patent [19]

Ishii

[11] Patent Number: 4,738,335

[45] Date of Patent: Apr. 19, 1988

[54] SCAFFOLDING SYSTEM FOR PERFORMING A WORK ON AN OUTER WALL SURFACE OF A BUILDING

[75] Inventor: Yasuo Ishii, Tokyo, Japan

[73] Assignee: Nihon Biso Kabushiki Kaisha, Tokyo, Japan

[21] Appl. No.: 70,184

[22] Filed: Jul. 6, 1987

[51] Int. Cl.[4] ..... E04G 21/24

[52] U.S. Cl. ..... 182/129; 182/138; 182/47

[58] Field of Search ..... 182/142, 143, 112, 47, 182/138, 129

[56] References Cited

U.S. PATENT DOCUMENTS

| | | | |
|---|---|---|---|
| 816,183 | 3/1906 | Pugh | 182/47 |
| 862,152 | 8/1907 | German | 182/47 |
| 1,012,947 | 12/1911 | Weisfeld | 182/138 |
| 3,566,991 | 3/1971 | Prouix | 182/129 |
| 3,586,125 | 6/1971 | Durand | 182/142 |
| 3,724,594 | 4/1973 | Jansson | 182/142 |
| 4,129,197 | 12/1978 | Preston | 182/138 |

FOREIGN PATENT DOCUMENTS

| | | | |
|---|---|---|---|
| 1499980 | 9/1967 | France | 182/138 |

*Primary Examiner*—Reinaldo P. Machado

*Attorney, Agent, or Firm*—Hedman, Gibson, Costigan & Hoare

[57] ABSTRACT

A scaffolding system for performing a work such as repair, coating or tiling on an outer wall surface of a building, chimney, petroleum tank or the like comprises parapet wall hooks provided on the top portion of a building, hanging stages suspended from the parapet wall hooks by means of first cables and arranged in horizontal alignment with one another, protective nets which can be stretched between the parapet wall hooks and the hanging stages, and means for lifting and lowering the protective nets by means of second cables secured to the protective nets. The protective nets can be lifted or lowered as desired regardless of position of the hanging stages and without lifting or lowering the hanging stages. The protective nets can be readily lowered and stored in the hanging stages when a strong wind is expected whereby damage to the protective nets due to wind can be prevented.

7 Claims, 4 Drawing Sheets

SCAFFOLDING SYSTEM FOR PERFORMING A WORK ON AN OUTER WALL SURFACE OF A BUILDING

BACKGROUND OF THE INVENTION

This invention relates to a scaffolding system for performing a work on an outer wall surface of a building.

For peforming works such as repair, coating or tiling on an outer wall surface of a building, chimney, petroleum tank or the like, it is necessary to provide a protective net over the wall surface. For providing the protective net, it has heretofore been conventionally practiced to construct a scaffolding with steel pipes along the wall surface and stretch a protective net over the entire area of scaffolding, fixing the protective net to the pipes constituting the scaffolding by means of clips. The works on the wall surface are performed by workmen standing on the pipe scaffolding. It however requires much time and cost to construct and disjoint the pipe scaffolding. It is particularly so when the works are performed on an outer wall surface of a multistoried building. Moreover, the conventional pipe scaffolding is inconvenient in that the outer wall surface of the building must be covered with the scaffolding and the net all the time until the work is finished.

For overcoming such inconveniences, the assignee of the present invention has proposed, as disclosed in Japanese Patent Publication No. 57-40313, a scaffolding system utilizing hanging stages. According to this scaffolding system, as shown in FIGS. 1 and 2, parapet wall hooks 3 are provided with intervals therebetween on a parapet 2 on the roof of a buiding 1. Hanging stages 6 are suspended from these parapet wall hooks by means of cables which are tied at the upper end thereof to the parapet wall hooks 3 and wound on winding drums 7 provided in the respective hanging stages 6. Each hanging stage 6 is capable of ascending and descending by driving the winding drums 7 and has a stop member 5 secured to the lower inside portion thereof and extending towards an outer wall surface 4 of the building 1 for stopping falling pieces. The hanging stages 6 are arranged horizontally along the outer wall surface of the building 1. Protective nets 9 are secured to the cables 8 or auxiliary cables (not shown) which extend from the parapet wall hooks 3 to the hanging stages 6 by means of clips 10. Thus, the protective nets 9 are stretched between the parapet wall hooks 3 and the hanging stages 6 so that the entire outer wall surface of the building 1 is covered with the protective nets 9 with a necessary space A defined between the protective nets 9 and the ourter wall surface 4. Working gondolas 12 which are suspended from the parapet wall hooks 3 by means of cables 11 and can ascend and descend by themselves are disposed in the space A. By ascending or descending these working gondolas 12 by driving self-ascending and descending device 13, works such as repair, coating and tiling are performed on the outer surface of the building 1.

In this prior art scaffolding system, the hanging stages 6 are gradually moved up or down in accordance with the progress of the work on the outer surface of the building 1. More specifically, when the work is started from the ground and is progressed towards the roof of the building 1, the hanging stages 6 are gradually lifted in accordance with the progress of the work performed by workmen working on the working gondolas 12 and the protective nets 9 which have become unnecessary due to lifting of the hanging stages 6 are taken in the hanging stages 6 as they are detached from the cables 8 or the auxiliary cables. Conversely, when the work is started from the top of the building 1 and is progressed towards the ground, the hanging stages 6 are gradually lowered in accordance with the progress of the work and the protective nets 9 which have been stored in the hanging stages 6 are taken out of the hanging stages 6 and attached to the cables 8 or the auxiliary cables by means of the clips 10. According to this prior art scaffolding device, the conventional pipe scaffolding can be obviated and therefore the time and costs which have been required for constructing and disjointing the pipe scaffolding can be saved and besides it becomes unnecessary to cover the entire outer wall surface of the building all the time until the work on the outer wall surface is finished.

This prior art scaffolding system, as well as the conventional pipe scaffolding, has the disadvantage that, if a work on the outer surface of a building is to be continued for days under the condition that the outer wall surface is kept covered with the protective nets, there sometimes occurs damage in the protective nets due to strong wind.

It is, therefore, an object of the invention to provide an improved scaffolding system for performing a work on an outer surface of a building which has eliminated the above described disadvantage of the prior art scaffolding system.

SUMMARY OF THE INVENTION

A scaffolding system achieving the above described object of the invention is characterized in that it comprises parapet wall hooks provided on the top portion of a building, hanging stages suspended from the parapet wall hooks by means of first cables and arranged in horizontal allignment with one another, protective nets which can be stretched between the parapet wall hooks and the hanging stages, and means for lifting and lowering the protective nets by means of second cables secured to the protective nets.

According to the invention, the protective nets can be lifted or lowered as desired regardless of position of the hanging stages and without lifting or lowering the hanging stages so that when a strong wind is expected, the protective nets can be lowered and stored in the hanging stages secured to the ground whereby damage to the protective nets can be easily prevented.

An embodiment of the invention will now be described with reference to the accompanying drawings.

BRIEF DESCRIPTION OF THE DRAWINGS

In the accompanying drawins.

DESCRIPTION OF A PREFERRED EMBODIMENT

Figure 2:
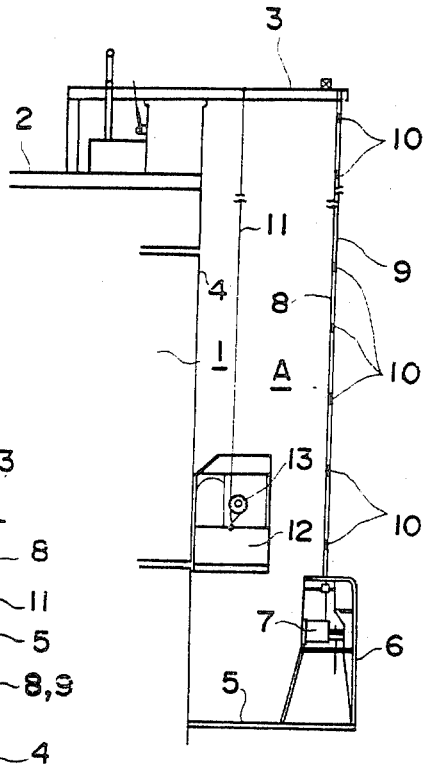
FIG. 2 PRIOR ART
FIG. 2 is an enlarged side view of an important portion of the prior art scaffolding system.
Figure 1:
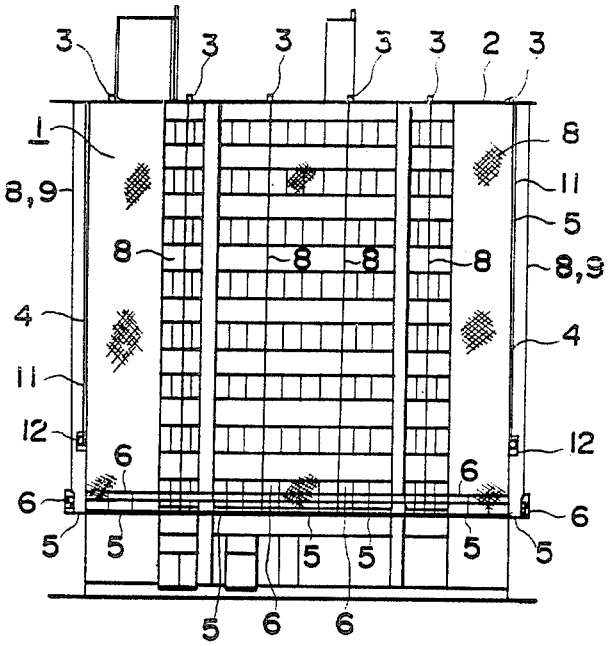
FIG. 1 PRIOR ART
FIG. 1 is a front view of the prior art scaffolding system.
Figure 3:
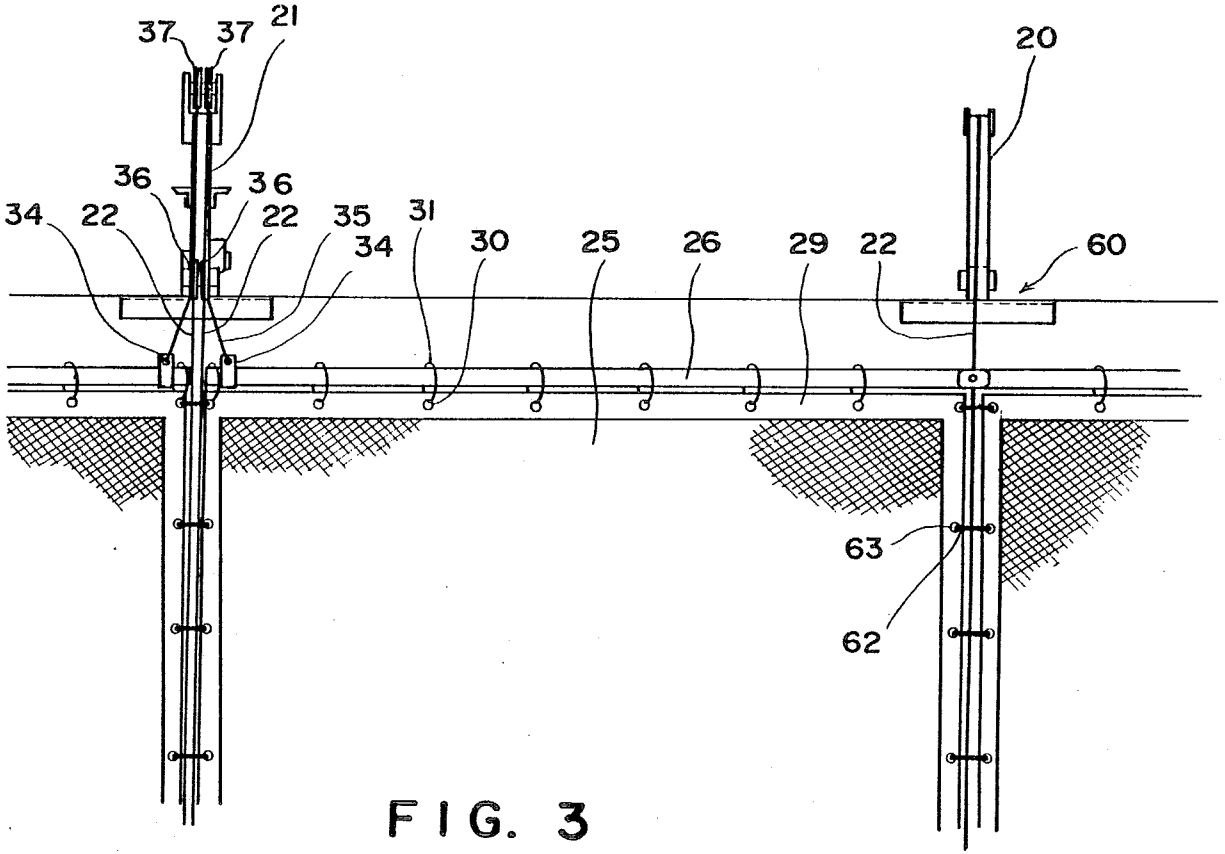
FIG. 3 is a front view of an important portion of an embodiment of the scaffolding system according to the invention.
Figure 5A:
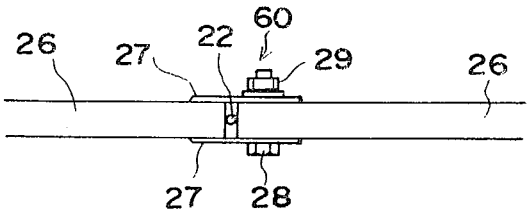
FIGS. 5A and 5B are enlarged views of an example of a joint for protective nets.
Figure 5B:
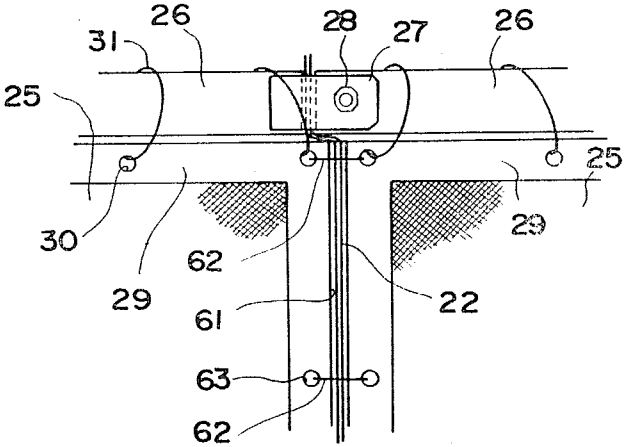
Figure 4:
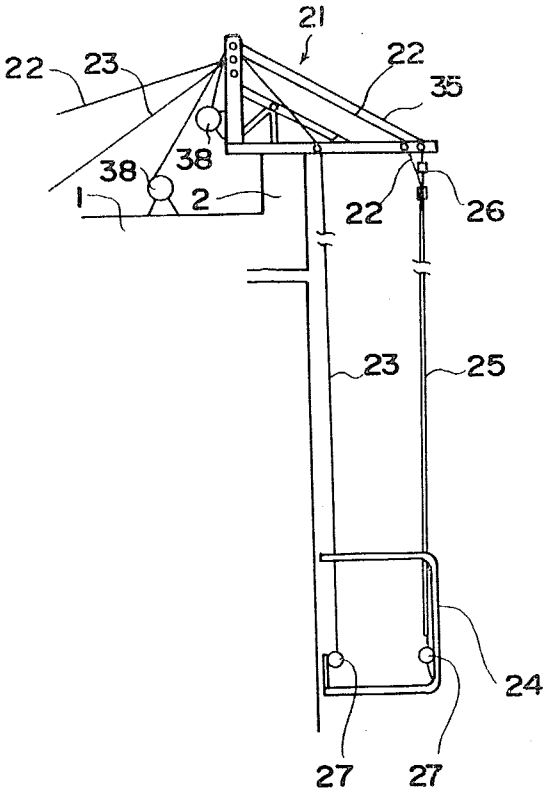
FIG. 4 is a partial side view of the embodiment of the scaffolding system.
Figure 7:
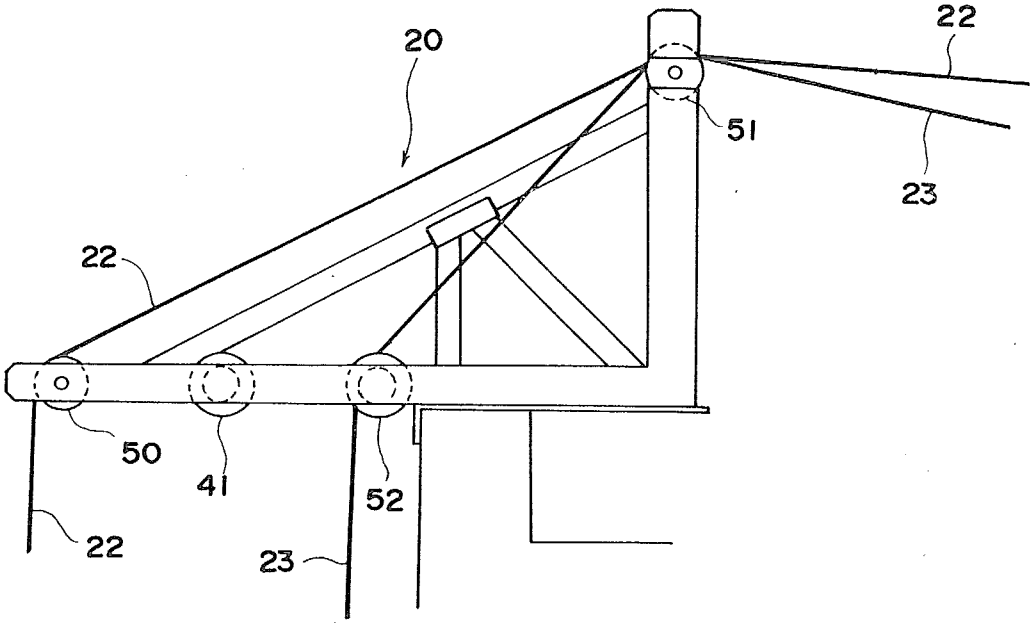
FIG. 7 is a side view of an example of a parapet wall hook used in the embodiment.

Referring to FIGS. 3 through 8, a preferred embodiment of the invention will be described.

Single sheave type parapet wall hooks 20 and double sheave type parapet wall hooks 21 are provided at suitable intervals on a parapet 2 of a building 1. A plurality of hanging stages 24 are suspended in horizontal allignment from the single sheave type parapet wall hooks 20 and the double sheave type parapet wall hooks 21 by means of front cables 22 and rear cables 23 which are respectively wound on winding drums 27 provided in a suitable location such as the base portion of the hanging stages 24. Each of the double sheave parapet wall hooks 21 has pairs of sheaves 36, 36, 37, 37, 40, 40, 55, 55 and 56, 56 arranged in parallel in the horizontal direction. The pair of front cabes 22 of each hanging stage 24 are connected at their upper end portions to a fastening device (not shown) provided at a suitable place on the roof of the building 1 via the sheaves 55 and 56 of the parapet wall hook 21 or the sheaves 50 and 51 of the parapet wall hook 20. The pair of rear cables 23 of each hanging stage 24 are connected at their upper end portions to a fastening device (not shown) provided on the roof via the sheaves 40 and 56 of the parapet wall hook 21 or the sheaves 52 and 51 of the parapet wall hook 20. In other words, each hanging stage 24 is suspended by a pair of adjacent parapet wall hooks 20 or 21, or by one parapet wall hook 20 and one parapet wall hook 21. The hanging stages 24 are capable of ascending and descending by themselves by driving the winding drums 27 and thereby feeding the cables 22 and 23 in and out of the winding drums 27.

Between each pair of the parapet wall hooks 21 and the hanging space 24 suspended from these parapet wall hooks 21, there are provided protective nets 25. The protective net 25 is secured to a protective net frame 29 and tied to a hanging bar 26 by means of tying strings 31 which pass through apertures formed in the frame 29. The hanging bar 26 is suspended from the adjacent parapet wall hooks 21 by means of cables 35 which are connected at the lower end thereof to fasteners 34 attached to the hanging bar 26 and wound at the upper end thereof on winding drums 38 via the sheaves 36, 36 and 37, 37. The winding drums 38 include electric motors and can be driven synchronously or individually by operation in an operation panel (not shown).

The protective nets 25 which are stretched between each adjacent pair of the parapet wall hooks 21 constitute a net group which can be lifted or lowered by such adjacent pair of parapet wall hooks 21 and a plurality of net groups are provided over the outer wall surface of the building 1 on which work is to be done. In the case where one net group consists of two or more protective nets 25, the hanging bars 26 for the adjacent protective nets 25 are hingedly connected to each other by a hinge device 60 which consists of a pair of levers 27 which are fixedly secured at one end thereof to the end portion of the hanging bar 26 of one protective net 25 and formed with apertures at the other end thereof, a bolt 28 inserted through these apertures of the levers 27 and an aperture formed through the end portion of the hanging bar 26 of the other protective net 25, and a nut 29 threadedly fitted on the bolt 28. The front cable 22 which is wound at the lower end thereof to the winding drum (not shown) provided in a suitable location of the hanging stage 24 and is connected to a fastening device (not shown) provided on the roof of the building 1 via sheaves 50 and 51 of the single sheave type parapet wall hook 20 passes through a gap formed between the opposing end portions of the hanging bars 26 of the adjacent protective nets 25 and passes further through a small elongaged gap 61 formed between the adjacent protective nets 25. The two adjacent protective nets 25 are tied to each other by means of tying strings 62 which are inserted in apertures 63 formed in the frames 29 of the protective nets 25 and is located outside of the cable 22 passing through the gap 61. Thus, the cable 22 extending between the parapet wall hook 20 and the winding drum of the hanging stage 24 serves as a guide for positioning the protective nets at their proper positions. In the parapet wall hooks 20 and 21, sheaves designated by reference numeral 41 serve for supporting cables for suspending working gondolas (not shown).

In operation, work on the outer surface of the building can be performed by suspending the hanging stages 24 in horizontal allignment with the protective nets 25 stretched between the parapet wall hooks 20 and 21 and the hanging stages 24 and lifting and lowering working gondolas in a space defined by the hanging stages 24 and the outer wall of the building 1. Alternatively, wordk on the outer surface of the building 1 can be made by lifting and lowering the hanging stages 24 directly by operating the winding drums mounted in the hanging stages 24 without using the working gondolas.

Figure 6:
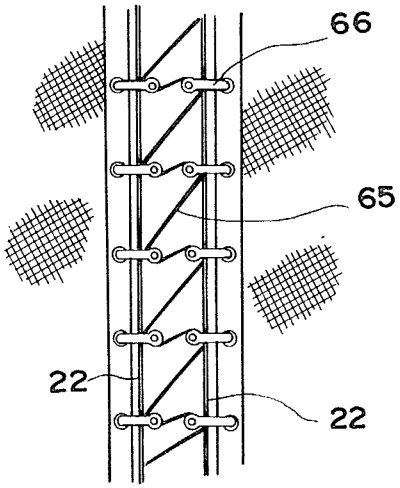
FIG. 6 is an enlarged front view of an example of connection of the protective nets.
Figure 8:
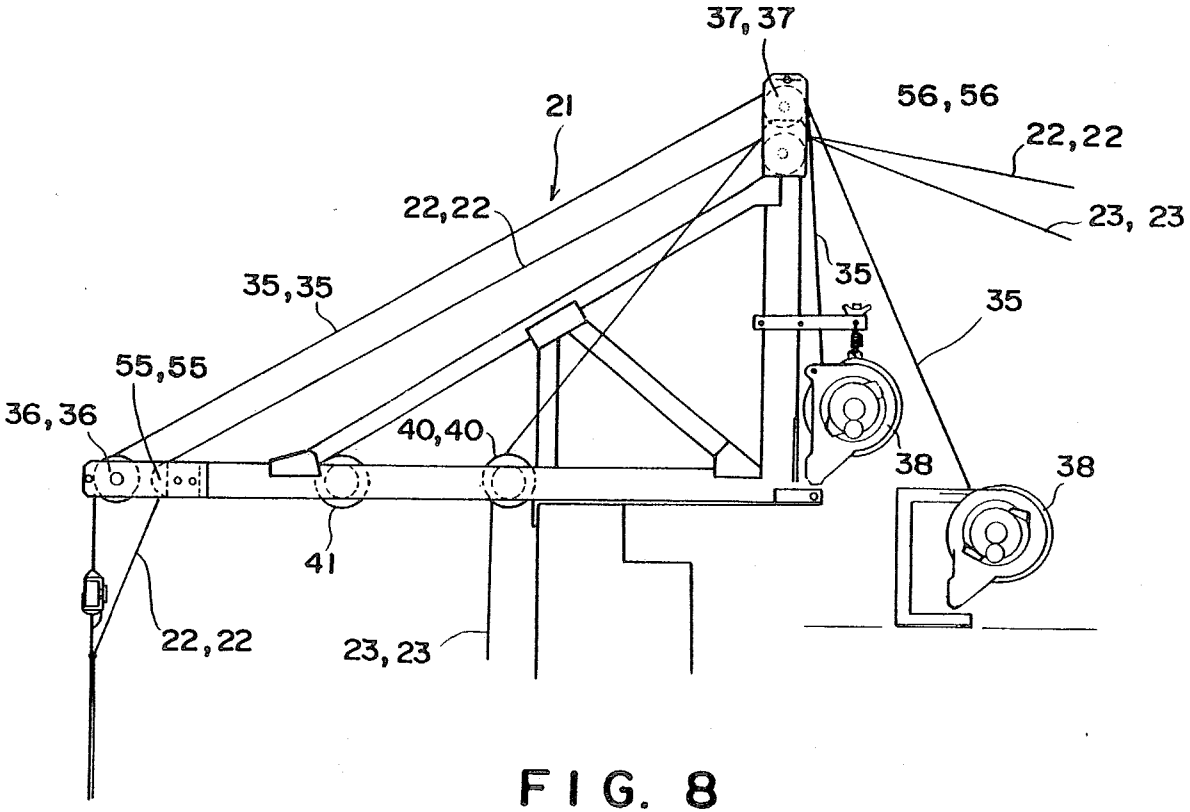
FIG. 8 is a side view of another example of a parapet wall hook used in the embodiment.

When two adjacent net groups have been stretched, the opposing edges of the adjacent protective nets 25 are connected together by a rope 65 which is inserted through clips 66 attached to the frames 29 as shown in FIG. 6. When two adjacent net groups are lowered, the two net groups are disconnected from each other by detaching the rope 65 so that each net group can be lowered independently from the adjacent net group.

The respective net group can be lifted or lowered individually or collectively. Each net group is normally operated individually by driving the pair of winding drums 38 for each net group synchronously.

A feature of the scaffolding system according to the invention is that the protective nets 25 can be lifted or lowered as desired regardless of position of the hanging stages 24 and without lifting or lowering the hanging stages 24. This is particularly advantageous when there is likelihood of damage to the protective nets 25 by a strong wind. When a strong wind is expected, the ropes 65 connecting the adjacent net groups are detached to release the adjacent net groups from each other and the winding drums 38 of each net group are synchronously operated through the operation panel to lower the net group and store the protective nets 25 in the hanging stages 24 positioned at their lowermost position and anchored securely to the ground. Thus, the protective nets 25 can be lowered and stored in the hanging stages 24 secured to the ground net group by net group.

The parapet wall hooks 20 and 21 are not limited to the above described type of hooks but any other suitable hooks may be used.

In the above described embodiment, the hanging stages 24 have winding drums mounted thereon for winding the cables 22 and 23 and are capable of ascending and descending by driving the winding drums. Alternatively, the hanging stages 24 may be lifted or lowered by winches provided on the roof of the building 1.

The scaffolding system according to the invention is applicable not only to office buildings but other buildings and structures including chimneys and petroleum tanks etc.

What is claimed is:

1. A scaffolding system for performing a work on an outer wall surface of a building comprising:

parapet wall hooks provided on the top portion of a building;

hanging stages suspended from the parapet wall hooks by means of first cables and arranged in horizontal allignment with one another;

protective nets which can be stretched between the parapet wall hooks and the hanging stages; and means for lifting and lowering the protective nets by means of second cables secured to the protective nets.

2. A scaffolding system as defined in claim 1 wherein said means for lifitng and lowering the protective nets comprises winding drums provided on the top of the building on which the end portions of the second cables opposite to the end portions secured to the protective nets are wound and drive means for driving the winding drums.

3. A scaffolding system as defined in claim 1 wherein said parapet wall hooks comprise a double sheave type parapet wall hook which has first sheaves for supporting two adjacent ones of the first cables of two adjacent ones of the hanging stages and second sheaves for supporting two adjacent ones of the second cables secured to the protective nets of said two adjacent hanging stages.

4. A scaffolding system as defined in claim 1 wherein the protective nets and the means for lifting and lowering the protective nets are divided in predetermined groups and the means for lifting and lowering the protective nets are driven in synchronism with one another for lifting and lowering the protective nets synchronously group by group.

5. A scaffolding system as defined in claim 1 wherein the hanging stages have winding drums mounted thereon on which the end portions of the first cables are connected for ascending and descending by driving the winding drums.

6. A scaffolding system as defined in claim 1 wherein the hanging stages are lifted and lowered by winches provided on the top of the building.

7. A scaffolding system as defined in claim 1 wherein space is defined between the protective nets stretched between the parapet wall hooks and the hanging stages and the outer wall surface of the building and working gondolas are suspended in this space.

* * * * *